United States Patent [19]

Wang

[11] Patent Number: 4,998,599

[45] Date of Patent: Mar. 12, 1991

[54] FOLDABLE LADDER

[76] Inventor: Tzann D. Wang, No. 409, Sec. 1, Lin Sen Rd., 18 Lin, Tung Ren Li, Hu Wei Chen, Yun Lin Hsien, Taiwan

[21] Appl. No.: 539,202

[22] Filed: Jun. 18, 1990

[51] Int. Cl.[5] ..... E06C 1/383

[52] U.S. Cl. ..... 182/160; 182/116; 182/151

[58] Field of Search ..... 182/159, 160, 161, 156, 182/116, 151

[56] References Cited

U.S. PATENT DOCUMENTS

| | | | |
|---|---|---|---|
| 434,792 | 8/1890 | Kopf | 182/159 |
| 2,088,878 | 8/1937 | Stogner | 182/162 |
| 2,670,120 | 2/1954 | Sanguineti | 182/160 |
| 3,084,760 | 4/1963 | Lamberti | 182/162 |
| 4,560,030 | 12/1985 | Mucelli | 182/161 |
| 4,618,027 | 10/1986 | Piretti | 182/160 |

*Primary Examiner*—Reinaldo P. Machado
*Attorney, Agent, or Firm*—Keaty & Keaty

[57] ABSTRACT

A foldable ladder including a foldable support frame mechanism and a head step assembly releasably mounted to the support frame mechanism. The head step assembly comprises a pair of base plates each having protuberances on both sides thereof and a number of step plates each having holes complementary in shape to the protuberances on the base plate. Two step plates and one base plate can be stacked together side by side through protuberance and hole engagement to form a bundle which can be stored within the support frame mechanism in its folded position.

5 Claims, 4 Drawing Sheets

FOLDABLE LADDER

BACKGROUND OF THE INVENTION

The present invention relates generally to foldable ladders comprising a head step assembly and a support frame means supporting the head step assembly. More particularly, the present invention relates to a head step assembly releasably mounted to a foldable support frame means in which the head step assembly is detachable for storage within the support frame means in its folded position.

The type of ladders having a foldable support frame are known. However, they can generally be folded to be a plane form for storage but not a line form in which the latter obviously has the advantages of handy and less bulky. Also, the head step assembly of conventional type ladders generally being permanently and fixedly attached to the support frame makes for inconvenient transport or storage.

To mitigate and/or obviate the above-mentioned drawback found in conventional ladders, the present invention proposes an improved ladder comprising a head step assembly mounted on a support frame means such that the head step assembly is detachable from the support frame means and further separatable into distinct pieces constituting the head step assembly when the ladder is not in use, in addition that the support frame means can be folded to form a bundle or a pack for easy handling and convenient transport. Also, the separate pieces of the head step assembly can be assembled to form another bundle or pack for placement within the support frame means again for easy handling and convenient transport.

SUMMARY OF THE INVENTION

Accordingly, it is an object of this invention to provide an improved foldable ladder comprising a head step assembly releasably fixed to a support frame means such that the head step assembly is further separatable into distinct pieces which constitute the head step assembly in order to subsequently form a bundle or pack for easy storage.

Further objects and advantages of the present invention will become apparent as the following description proceeds, and the features of novelty which characterize the invention will be pointed out with particularity in the claims annexed to and forming a part of this invention.

BRIEF DESCRIPTION OF THE DRAWINGS

The above objects and other features and advantages of the present invention will become more readily apparent when considered in conjunction with the detailed description and the accompanying drawings wherein.

DETAILED DESCRIPTION OF THE PREFERRED EMBODIMENT

Figure 1:
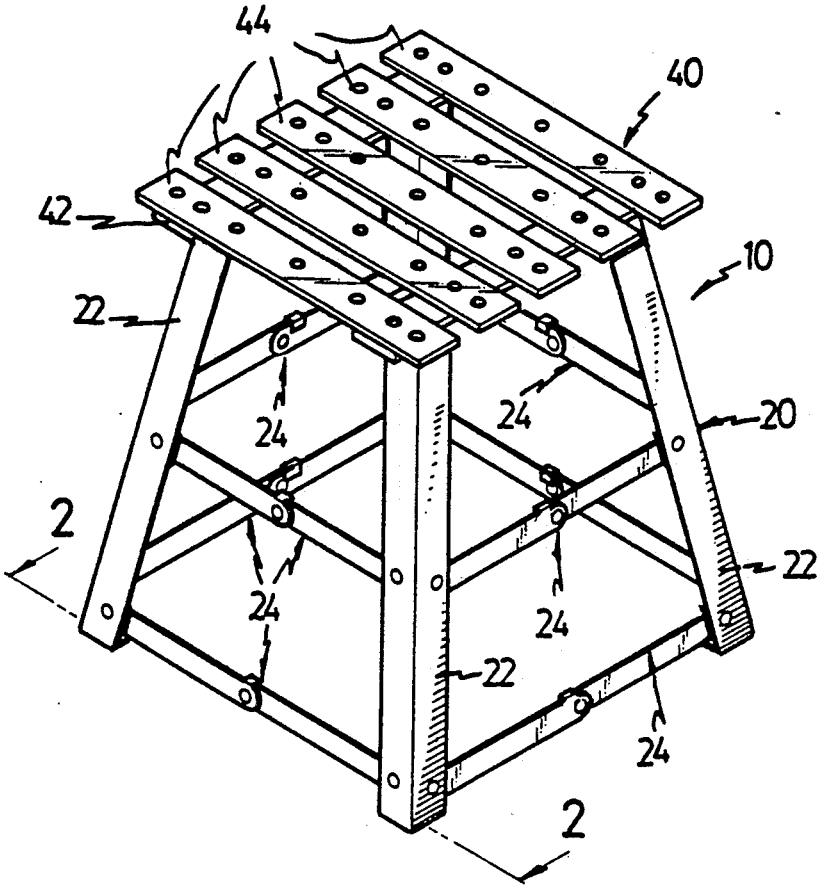
FIG. 1 is a perspective view of the ladder comprising a head step assembly mounted on a support frame means according to the present invention.
Figure 4:
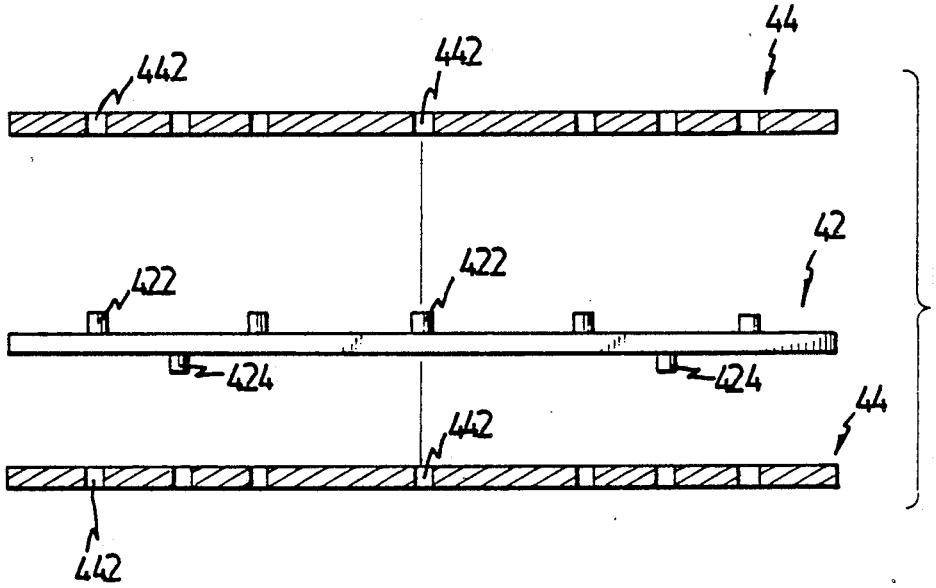
FIG. 4 shows one base plate and two steps plates of this invention in section when in a folded position.

Referring now to the drawings, and more particularly to FIGS. 1 and 4, there is shown the ladder, generally designated by reference number 10, which incorporates the preferred embodiment of the present invention. The ladder 10 comprises a support frame means 20 consisting of four legs 22 interconnected by a plurality of linking rods 24 disposed between adjacent legs at their intermediate and lower positions, respectively. FIG. 1. also clearly shows that the four legs 22 of the support frame means 20 are slightly splayed outward, with the lower linking rods 24 thus being longer than the intermediate linking rods 24 to accommodate this construction, in order to firmly support the frame, as well as a head step assembly 40 releasably mounted on the support frame means 20. The construction of leg 22 and linking rod 24 per se are known so that detail descriptions therefor are deemed unnecessary.

The head step assembly 40 of this invention comprises a pair of base plates 42 parallel from each other and a plurality of step plates 44 (five being shown in this embodiment) each having holes 442 thereon (seven holes being shown in this embodiment).

Figure 2:
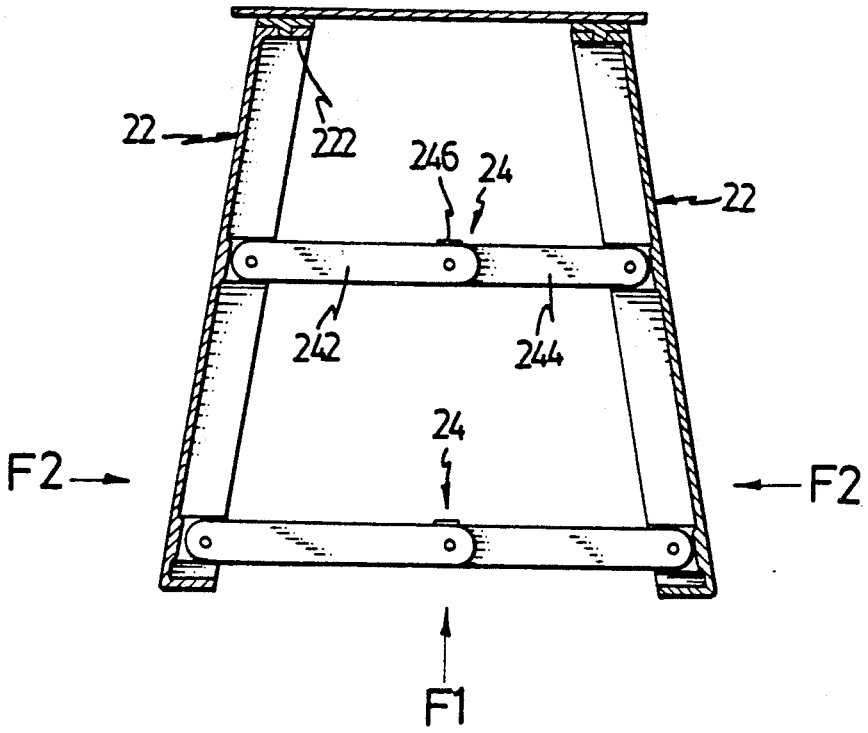
FIG. 2 is a section view taken along line 2—2 of FIG. 1, showing the ladder of this invention in an open position.

As shown in FIG. 4, each base plate 42 has two first protuberances 424 at a bottom side for detachably fixing to an upper end plate 222 of the support frame means 20(see FIG. 2) when the support frame means 20 is in the open position of FIGS. 1 and 2. The base plate 42 also has a plurality of second protuberances 422 corresponding in number of the number of step plates (i.e. five) at a top side thereof. The second protuberances 422 of the base plate 42 are shaped and sized to fit in the holes 442 of the step plate 44 so tht step plates 44 cross over the base plates 42 and spaced parallel, with the protuberances 422 being snugly fitted into the hole 442, when the support frame means 20 is in its open position.

Figure 5:
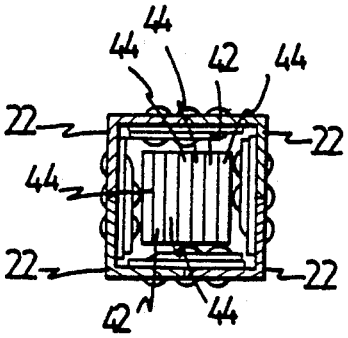
FIG. 5 shows one base plate and two step plates of this invention which can be stacked together and stored within the support frame means in its folded position.

As can be understood from FIGS. 1, 4 and 5, the number of base and step plates 42, 44 as well as the number of protuberances and holes 422, 424, 442 are relevant and are selected in such a way that the step plates 44 are capable of being stacked against both the top and bottom sides of the base plate 42. The stacked base and step plates 42, 44 then can be suitably stored within the support frame means 20.

Figure 3:
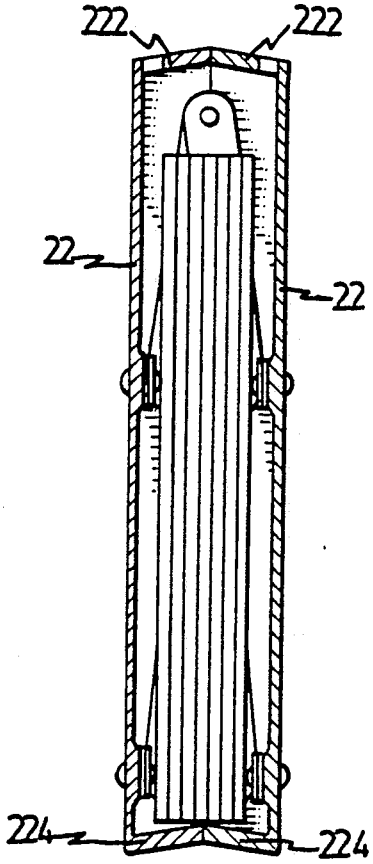
FIG. 3 is a view similar to FIG. 2 but showing the ladder of this invention in a folded position.

FIGS. 2 and 3 respectively show a section view of the ladder 10 of this invention in an open and a folded position. Adjacent the connection point of the two members 242, 244 of each linking rod 24 there is formed a stop 246 on one of the members. When the support frame means 20 is splayed outward the stop 246 serves to retain the support frame means 20 in the position of FIG. 2 while preventing its further downward movement. To fold the legs 22 of the support frame means 20 from the position of FIG. 2 to the position of FIG. 3, it is necessary to urge or push the linking rods 24 in the direction of arrow F1 and the legs 22 in the direction of arrow F2.

As described above, a feature of this invention is that the step plates 44 and the base plates 42 can be stacked together side by side to form a bundle. FIG. 5 illustrates the interconnected base plates 42 and step plates 44 which may be stored within the support frame means 20 in its folded position.

While the present invention has been explained in relation to its preferred embodiment, it is to be understood that various modifications thereof will be apparent to those skilled in the art upon reading this specification. For example, it is apparent that the engagement between the step plate and the base plate can be enforced by more than one set of protuberances and holes. Also, it is obvious that the shape of the protuberances and corresponding holes may be suitably selected, instead of cylindrically shaped. Further, the holes 442 on the step plate 44 can be recesses, instead of through-holes to meet the same purpose. Therefore, it is to be understood that the invention disclosed herein is intended to cover all such modifications as shall fall within the scope of the appended claims.

I claim:

1. In a foldable ladder comprising a head step assembly, and a support frame means capable of being in an open position for supporting said head step assembly and being in a folded position for storing said head step assembly, wherein the improvements comprise:

said head step assembly comprising a pair of base plates spaced parallel to each other and a plurality of step plates each having holes thereon; said pair of base plates each having two first protuberances at a bottom side thereof for detachably fixing to said support frame means in its open position, and having a plurality of second protuberances corresponding in number to said step plates on a top side thereof, said second protuberances receiving said holes of said step plate so that said step plates cross over said base plates with one spaced parallel to another when said support frame means is in the open position; said step plates being stackable against both a top and bottom side of said base plate, said stacked base and step plates being storable within said support frame means in its folded positon.

2. The foldable ladder as claimed in claim 1, wherein said step plate has a plurality of holes corresponding in position and number to said first and second protuberances of said base plate on opposite sides so that said step plates are attachable to said base plate at opposite sides.

3. The foldable ladder as claimed in claim 1, wherein said second protuberances of said base plate extend such a height which is not larger than the thickness of said step plate.

4. The foldable ladder as claimed in claim 1, wherein said step plates have recesses instead of holes passing therethrough.

5. The foldable ladder as claimed in claim 1, wherein said support frame meanns comprises four legs slightly splayed outward at lower end thereof for firm support and connecting means interconnected between adjacent legs, said legs each having a substantially L-shaped cross-section frame and an upper end plate, one pair of said upper end plates releasably receiving one of said base plates, said connecting means comprising a first pair of linking rods connected at a substantially intermediate position of said leg and a second pair of linking rods connected at a lower position of said leg.

* * * * *